United States Patent [19]

Fidalgo

[11] Patent Number: 4,765,748

[45] Date of Patent: Aug. 23, 1988

[54] BODY CONTACT GAME

[76] Inventor: Loren C. Fidalgo, 304 Arch St., Apt. 4F, Philadelphia, Pa. 19106

[21] Appl. No.: 839,130

[22] Filed: Mar. 12, 1986

[51] Int. Cl.[4] ..... A63F 9/00

[52] U.S. Cl. ..... 273/1 G; 273/1 GF; 273/1 GG; 273/DIG. 19; 273/DIG. 30

[58] Field of Search ..... 273/1 G, 1 GG, 1 GF, 273/55 C, DIG. 19, DIG. 30

[56] References Cited

U.S. PATENT DOCUMENTS

| | | | |
|---|---|---|---|
| 3,063,718 | 11/1962 | Steinkamp | 273/55 C |
| 3,200,536 | 8/1965 | Petitto, Sr. | 273/DIG. 19 |
| 3,479,027 | 11/1969 | Fryer | 273/1 G |
| 3,498,610 | 3/1970 | Foley et al. | 273/1 G |
| 3,533,622 | 10/1970 | Foley et al. | 273/1 G |
| 3,778,055 | 12/1973 | Witkowski | 273/1 G |
| 3,788,641 | 1/1974 | Lemelson | 273/DIG. 30 X |
| 3,936,051 | 2/1976 | Walker, Jr. | 273/DIG. 19 X |
| 4,071,237 | 1/1978 | Hoogasian | 273/1 G |
| 4,303,247 | 12/1981 | Fain | 273/DIG. 30 X |
| 4,304,403 | 12/1981 | Wilson | 273/55 C |
| 4,364,561 | 12/1982 | Gill | 273/1 G |
| 4,653,582 | 3/1987 | Ehrenfried | 273/DIG. 30 X |

*Primary Examiner*—Paul E. Shapiro

[57] ABSTRACT

A game played with a plurality of hooks and/or interchangeable indicia which can be attached to mounts on an expandable belt in which a plurality of players must transfer corresponding loops, Velcro patches and other varying transferable indicia to a designated receiving partner, intending to receive the transferable indicia onto his or her said belt. Other variations include manipulation of ravelled twine on knob-like spools between partners on same said belt.

One of the partners wears the belt with the transferable or manipulative indicia which connect onto belt by virtue of belt mount. The hooks and knob-like spools connect to these said belt mounts. The Velcro patches are generally affixed to actual belt. The team partners must then manipulate their body movements, stressing physical contact, in such a way as to enhance transfer or proper manipulation of indicia between partners. This process is done sequentially; transfering or manipulating the various indicia from one location on belt of one partner to corresponding location on belt of second partner. Speed of transfer or manipulative process is the goal. The first set of partners to transfer or manipulate the set of indicia properly wins. The belts and accompanying belt mounts are colored aesthetic purposes. (Each player receives a colored belt and accompanying belt mounts of the same color).

8 Claims, 5 Drawing Sheets

FIG.3
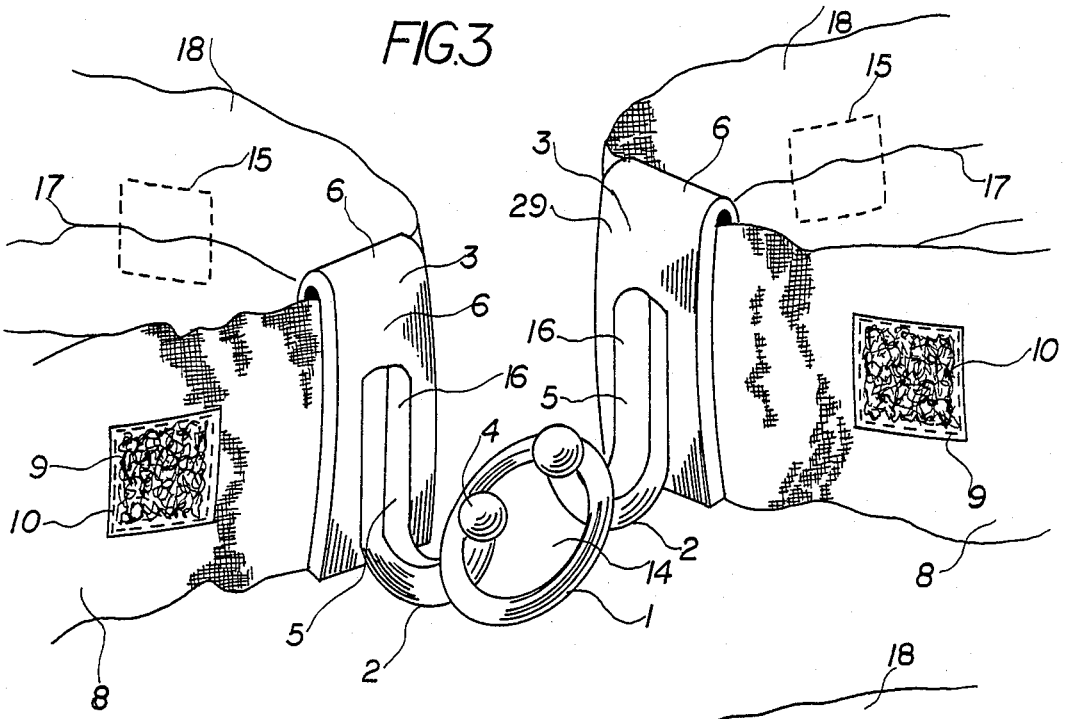
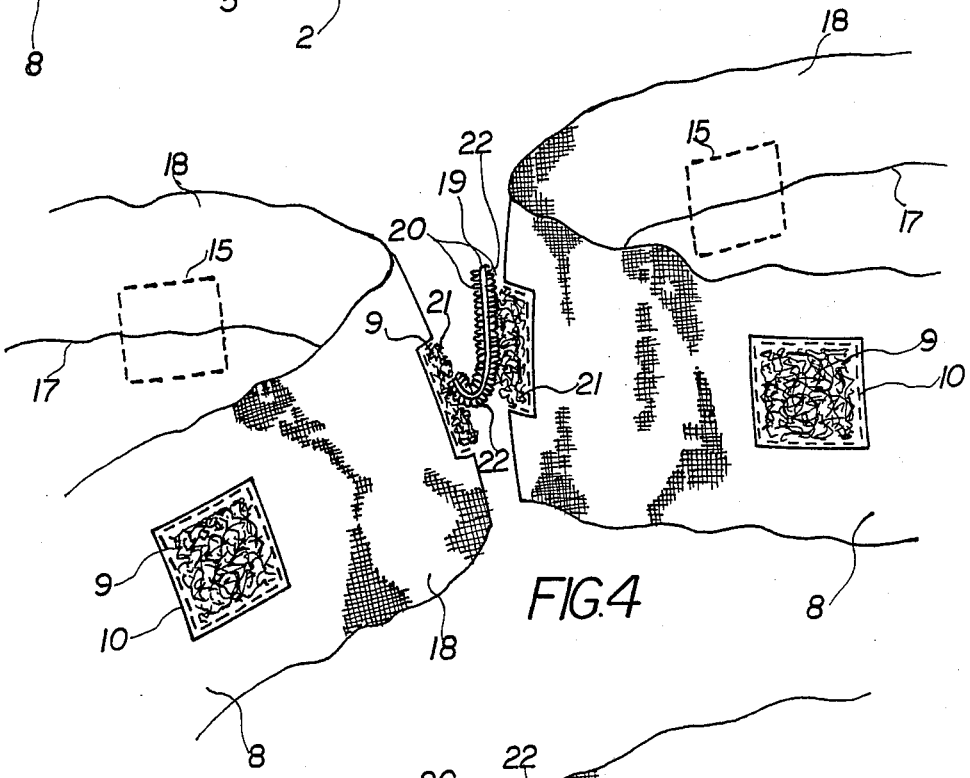
FIG.4
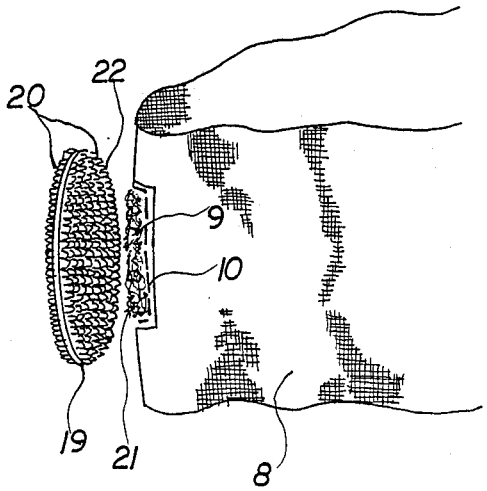
FIG.5

FIG. 6
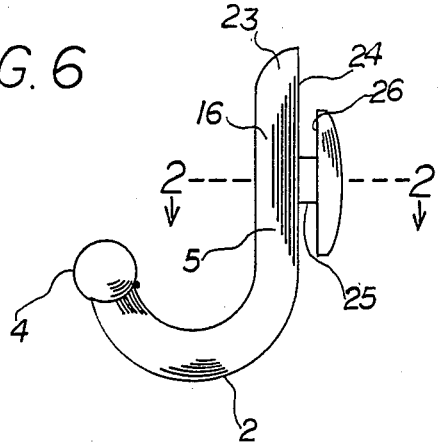
FIG. 7
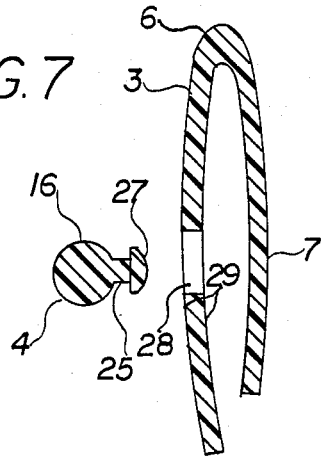
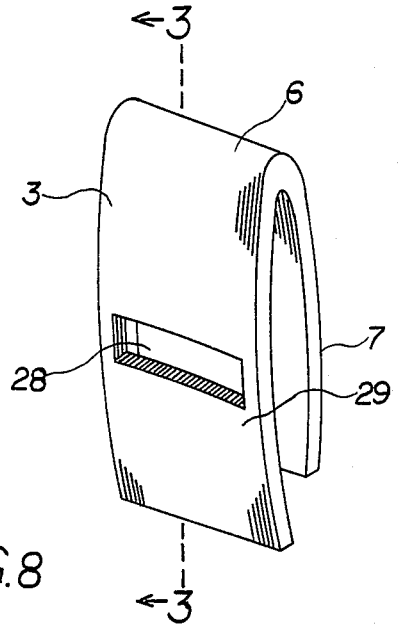
FIG. 8
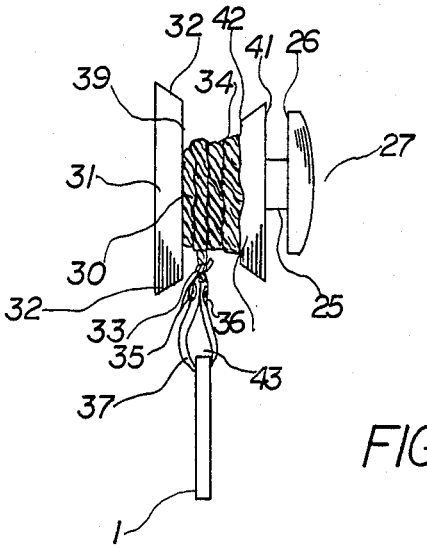
FIG. 9
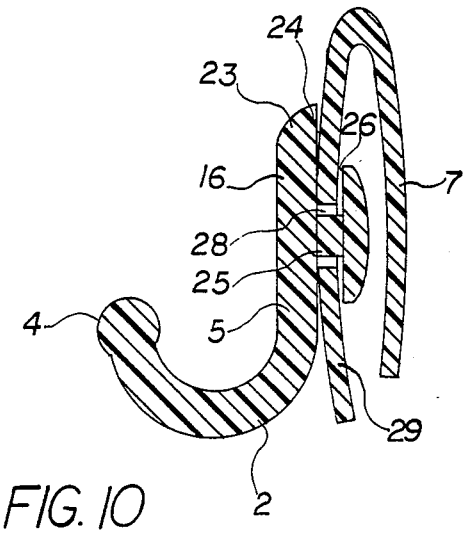
FIG. 10
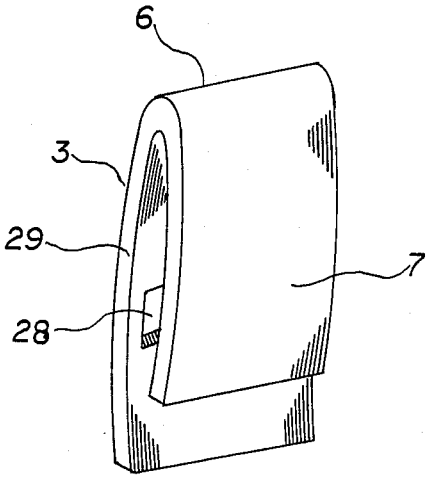
FIG. 11

BODY CONTACT GAME

BACKGROUND OF THE INVENTION

1. Field of the Invention

The present invention relates to a social game for a plurality of playing partners wherin partners must use coordination and physical contact to transfer and/or manipulate objects worn on belts. Teams of partners race to achieve the transfer and/or manipulate process first.

2. Description of Prior Art

U.S. Pat. No. 3,498,610 dated Mar. 3, 1970 is directed toward a game wherin opposing players engage themselves in a contest to capture colored rings worn on belts.

The players gather in specified safe areas, and when called to do so, must leave safe areas into a free zone where they are supposed to grab the colored rings called. The players then return to safe areas. This process continues until all the colored rings are in the possession of one of the players. The object is to hold in your possession, the most rings.

In U.S. Pat. No. 4,364,561 issued Dec. 21, 1982, a party game apparatus is provided wherin male and female buckles are attached to belts. The male buckle consists of a tongue which is intended to be inserted into the female buckle which consists of a tunnel with U-shaped side slots that movably retain a double headed marker pin. When the male tongue is physically manipulated by player into the female tunnel of the other partner and moves the marker pin from one slot to the other slot on female buckle, the game objective is accomplished.

In U.S. Pat. No. 3,533,622 dated July 11, 1968, is directed towards a game wherin opposing teams of players engage in a process to connect themselves by hooks worn on belts, arm bands, and wrist bands.

The players were the flexible straps and belts on which disengagable hooks are attached. The hooks are color coded for game purposes. Two cards are drawn randomly which determines which color hooks are to be connected by players. The playing cards are color coded in the same manner as the rings. The object of the game is to interconnect the greatest number of hooks. The pair of players which do so, wins the game.

It is an object of the present invention to provide a new and improved game for teams of two or more players which requires coordination and body contact by virtue of an improved belt game process.

It is also an object of the present invention to provide a new alternative to social interaction, wherin players will be subjected to situations more conductive to conversations and "breaking the ice", thus simplifying the communication process.

It is yet another object of the present invention to provide a new game which induces exercise and body contact which is relatively simple and economical.

The present invention incorporates an already widely used patent called Velcro. It is sold by Velcro Manufacturing Co. of Manchester, N.H. under the trademark, Velcro. Similar fastening material, which is incorporated in the present invention, is sold under the trademarks of Scotchmate and Mastex. More specific information about the Velcro Fastening System maybe obtained from the literature, e.g., U.S. Pat. Nos. 2,717,437 and 3,114,951. As is known, this fastening system employs a pair of complementary elements. The first element (male) is a tape. (i.e. a strip of fabric, from which a multiplicity of tiny plastic hooks project, and the second (female) is a corresponding strip from which a multiplicity of tiny plastic loops similarly project). The two elements are adopted to be releaseably secure by mere contact with each other. To that end, when the components are brought together into contact with eachother, many of the hooks of the male element engage many of the loops of the female element. When so secured, the two elements can be easily separated just by pulling them apart.

SUMMARY OF INVENTION

The present invention relates to a new and improved game device for a plurality of playing partners comprising of a plurality of expandable cloth belts with disengageable mounts of nine to be worn on hips, legs, or any other part of the body. Said belt also consists of nine generically affixed Velcro patches equidistant from each other. Belt mounts, when in use, should also be placed equidistant from eachother on belt apparatus. The belt mounting mechanism allows a variety of indicia to be connected to belt for play. The present indicia which must use the belt mount for connection to belt are the hooks and knob-like spools. Belt mount device is produced in such a way, however, to allow a multiplicity of interchangeable variations of game to be mounted on belt. All present indicia include hooks, rings (two sizes), knob-like spools with connecting twine and snap, belt mounts, belts and Velcro patches.

The present invention allows for three variations of the game to be played depending on the indicia chosen by players. In all of the variations, the objective is to be the first team to complete the designed transfer and/or manipulation process for each indicia in that particular indicia group. If hooks are chosen a desirable indicia, then all players must use belt mounts to fasten hooks to their belts. A desired ring size must be chosen by players, depending on the degree of difficulty desired. For this particular embodiment, one partner places the desired size ring over his or her hook. When all playing partners have reached this point, the game variation begins. The playing partners must transfer the rings from one partner's hooks to the other partner's corresponding hooks. The pair of players who transfer all the rings first has won the game.

If Velcro patches are chosen as the players desired indicia, then belt mounts can be easily removed. Partners are again chosen. One partner will place the Velcro patches onto his or her belt receiving areas. When all players are set, the transfer process begins. The partners must transfer the Velcro patches from one partner's receiving area to the other partner's corresponding receiving area. This transferring process requires much body contact as to allow the hooks on the Velcro patch to connect to the strands of the receiving area. The first pair of players to transfer all corresponding Velcro patches wins.

If yet knob-like spools are the chosen indicia, both players must attach the belt mounts ot the belt. One partner will attach the knob-like spools to his or her belt mounting devices. A ring must be snapped into position at the end of each piece of twine on knob-like spools. Twine is then wrapped tightly around spool leaving ring left dangling. Once teams are set, play begins. Playing partners must first attempt to insert hook into ring. Partners must then manipulate their body movements in such a way as to unravel spool of twine without using their hands and without disengaging the hook-ring connection once process begins. If hook becomes disengaged from ring, the twine must then be rewrapped back onto spool and attempted again. Once spool has been unraveled, partners move onto next corresponding hook and knob-like spool. The first team players to unravel all the knob-like spools, in order, wins.

DESCRIPTION OF DRAWINGS

FIG. 3 is a sectional view illustrating one form of apparatus made in accordance with present invention.

FIG. 4 is a sectional view illustrating one form of apparatus made in accordance with present invention.

FIG. 5 is an enlarged verticle sectional view of one of the transferable devices in accordance with present invention.

FIG. 6 is a side view of hook apparatus.

FIG. 7 is a sectional view taken along line 2—2 of FIG. 6 combined with line 3—3 of FIG. 8.

FIG. 8 is a perspective view of belt mounting device.

FIG. 9 is a side view of knob-like spool apparatus with connecting twine and ring.

FIG. 10 is a sectional view of hook connected to belt mounting device.

FIG. 11 is a back perspective view of belt mounting device.

DESCRIPTION OF PREFERRED EMBODIMENTS

Figure 2:
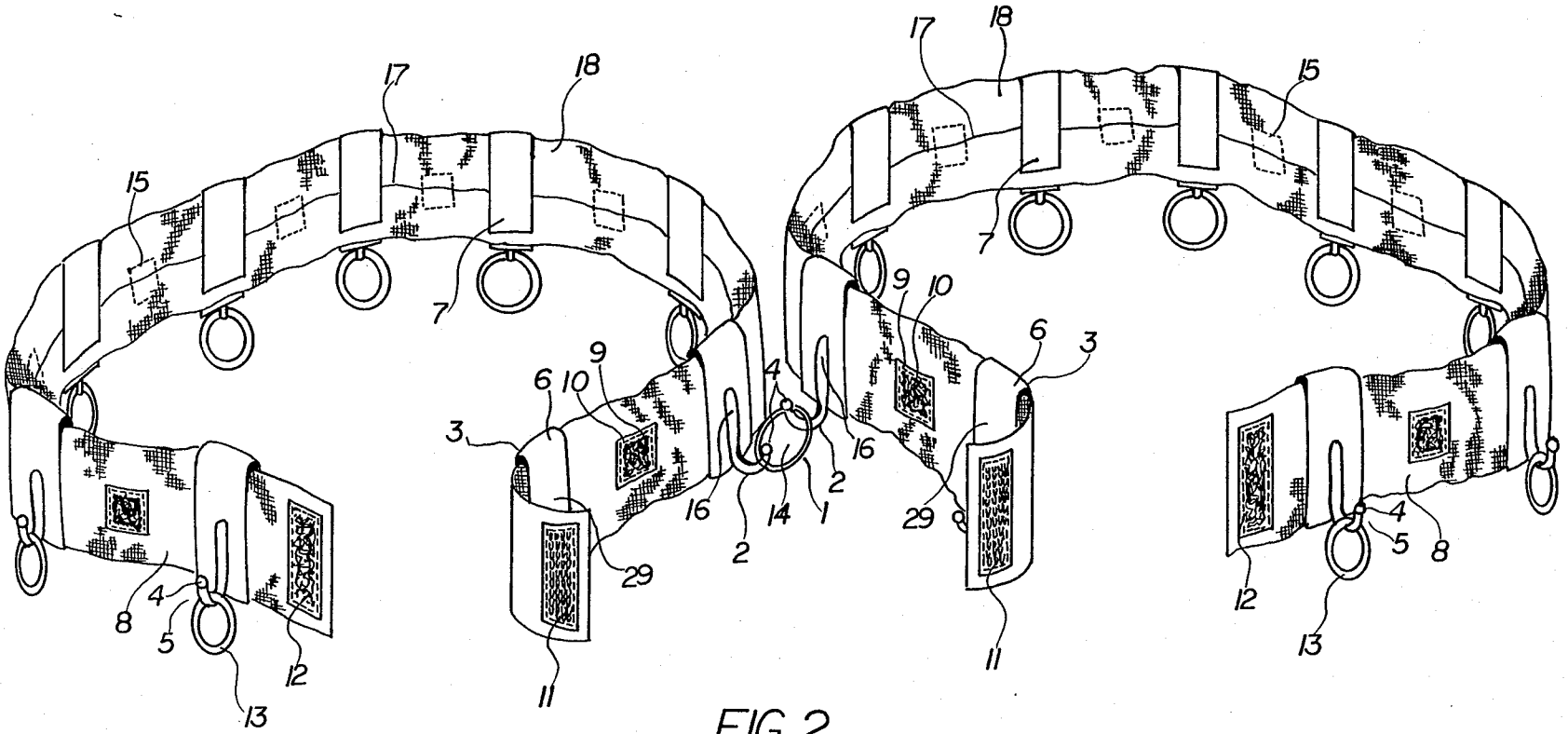
FIG. 2 is a perspective view of a social game.

Referring first to FIG. 2, there is shown generally two game device of one variation 18 comprising of two belts 8. made in this instance with cloth and elastic but any expandable materials will suffice, two Velcro fastening devices 11,12, representing the hooks and strands described in Velcro patent, a plurality of belt mounting devices 3, connect with a front and back limb onto the belts 8. A curved injection moulding of belt mounting device 6 creates space between mounting device front and back limb 29,7, respectively. Space between limbs allow belt mounting device to slide onto belt. The two belts contain a plurality of receiving areas 9 which are sewn on, 10 shows frontal stitching and 15 shows back stitching. Belt mounting devices contain a plurality of hook indicia 5 consisting of straight shank portion 16 and curved lower portion 2. The free end of curved lower portion is provided with knob 4. Top of indicia hooks when connected to belt mounting device create a flush connection 16. A plurality of rings 13 can be seen dangling from hooks with plenty of room provided to ensure free movement of rings 14 on hooks while in the process of being transfered.

Figure 1:
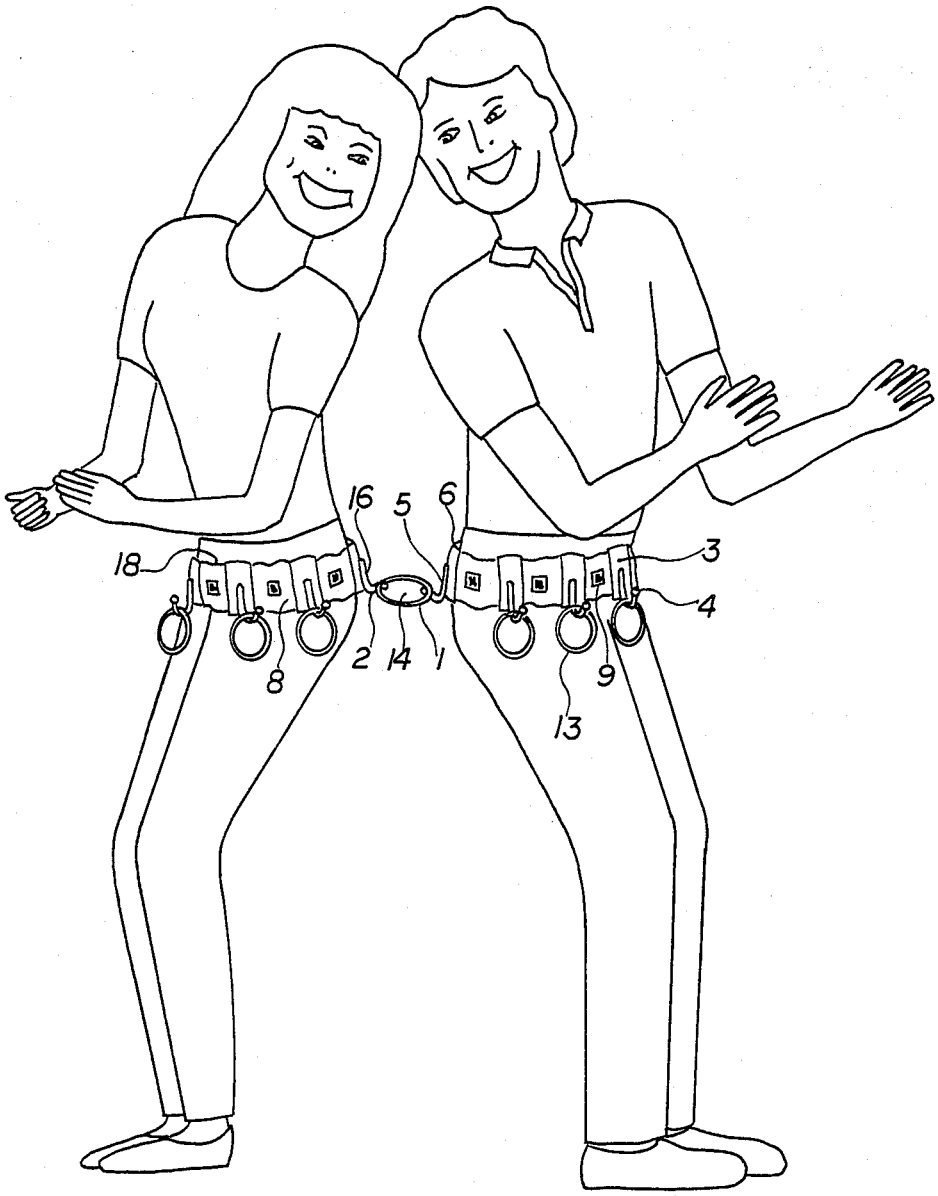
FIG. 1 is a schematic illustration of the social game as it might be used by two players.

FIG. 1 represents one of the preferred embodiments when hooks are the chosen variation of game. Expandable belts, by virtue of elastic seam sewn in belt 17 of FIG. 2, allow for slight play in belt expansion while transferring rings. FIG. 3 more clearly demonstrate the intended goal of the hook variation portion of the game. The knobs 4 in FIG. 3 show their effectiveness by somewhat detterring ring to slide off hook too easily.

Referring now to FIG. 4, another preferred embodiment needs to be discussed. In this embodiment, the belt mounting devices are removed from belt as well as the hooks and rings used in first embodiment. The strands of the receiving material 9 play the major role along with the transferrable patch or Velcro patch 19. This patch actually has two sides of hooks illustrated by number 20 which easily adhere to strands of previously discussed receiving patches 9. The patches are larger in size than the receiving areas creating a sort of lip 22 which eases the transfer process. FIG. 5 illustrates this more clearly.

Figure 12:
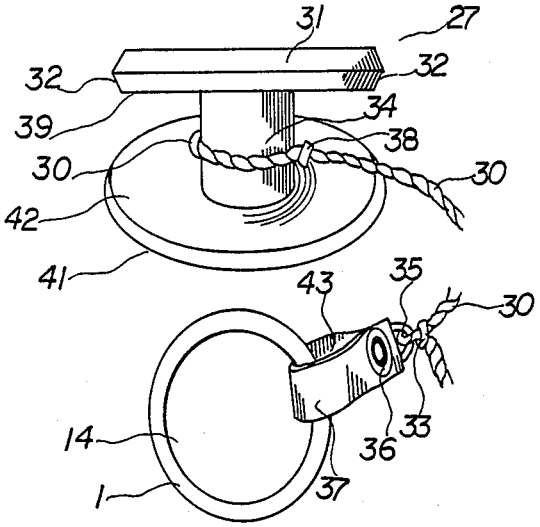
FIG. 12 is a perspective view of knob-like spool connected to twine and twine, strap, ring connection.

The third preferred embodiment requires players to replace belt mounting devices onto belt and then one playing partner attaches the knob-like spools 27 onto his or her belt while the other partner attaches the hook indicia. The knob-like spool consists of a dowel or spool 34 in FIG. 9 and 12. The dowel connects the front of the knob-like spool 31 to the front of base 42. 39 represents the back of the knob which prevents twine 30 from unravelling with a simple straight pull. There are bevelled edges of knob 32 which further restrain twine from unravelling. The twince is tied to spool or dowel 38 so desired ravelling and unravelling can take place. Twine is connected on opposite end by knot 33 which is attached to small eyelet 35 which connects to plastic band 37 which is somewhat loosely fitted 43 to allow ring indicia 1 to fit inside and still have room to close band with snap 36. See FIGS. 9 and 12. Both the hooks and knob-like spools have protruding connect ing mechanism elements 25,26,27. This protrusion allows for the hooks and knob-like spools to be connected onto belt mounting devices. This protrusion on the hooks and knob-like spools is turned 90° and thus fits into the belt mounting oriface 28, FIG. 8. Once protrusion is inserted, the hook or spool must be turned back to the original position. This connecting mechanism allows for many variations of embodiments and reduces cost of manufacturing, as well as packaging space.

The players readied for the third embodiment must attempt to first connect hook and ring of partners together. The object is to then unravel partners coil of twine without disconnecting the hook and ring. If hook and ring become disconnected players must start process over. The object, again, is to race to complete process of unravelling on all knob-like spools first.

Figure 13:
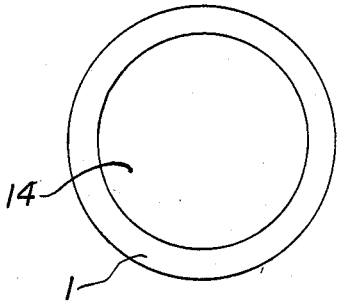
FIG. 13 is a frontal view of large ring.
Figure 14:
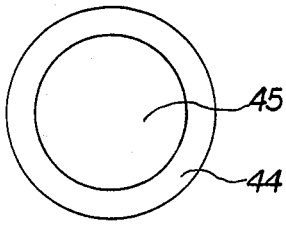
FIG. 14 is a frontal view of small ring.
Figure 15:
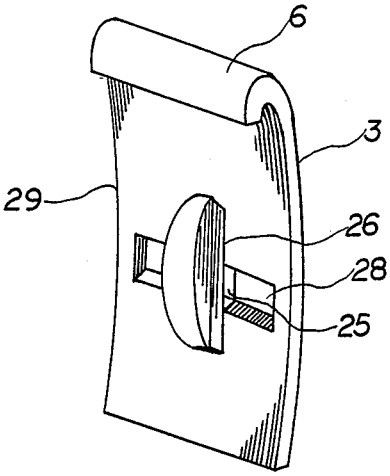
FIG. 15 is a cutaway back view of belt mounting device and function of indicia protrusion.
Figure 16:
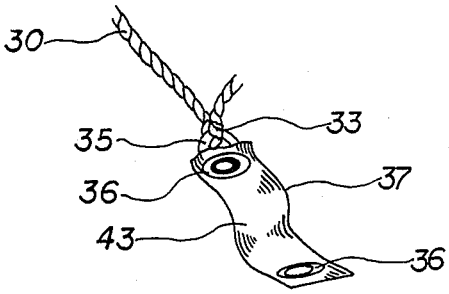
FIG. 16 is a perspective view of connection between twine and snap
Figure 17:
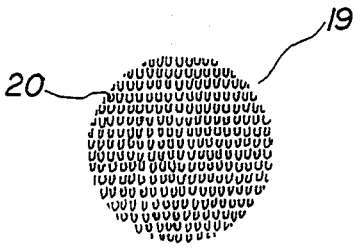
FIG. 17 is a frontal view of Velcro patch or transferable patch.
Figure 18:
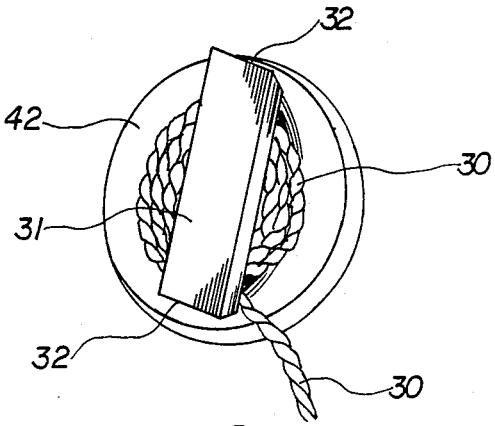
FIG. 18 is a frontal perspective view of knob-like spool and connected twine.

All three embodiment leave choice to player as to the degree of difficulty FIGS. 13 and 14 show the varying sizes of injection moulded rings which can be chosen.

What is claimed is:

1. A game apparatus for one or more opposing pairs of players, comprising:

(a) a plurality of belts to be worn by the players, each belt having a plurality of spaced apart receiving areas thereon for removably holding transferrable patches thereon;

(b) a plurality of belt mounting devices, each belt mounting device comprising means for attaching the belt mounting device to one of the belts, and means for removably attaching to the belt mounting device different game elements;

(c) first game elements comprising hooks removably attachable to said belt mounting devices;

(d) second game elements comprising spools removably attachable to said belt mounting devices, each spool having wound thereon a length of twine the free end of which has mounted thereon an openable and closable connection loop;

(e) a plurality of transferrable patches which may be attached to a receiving area on one belt and be transferred to another belt by contact with the receiving area on the other belt; and (f) a plurality of rings.

2. The apparatus of claim 1, wherein said receiving areas comprise patches of strand-like material, and said transferrable patches have small hook-like materials on opposite sides thereof.

3. The apparatus of claim 1, wherein the means for attaching the belt mounting devices comprises each device having two opposed limbs separated by a substantially belt-thickness space, said limbs being connected along one side to each other forming a U-shaped clip which may be slipped over the belts.

4. The apparatus of claim 1, wherein the means for removably attaching different game elements to the belt mounting device comprises an elongate aperture in each belt mounting device and a T-shaped head on each game device, whereby the T-shaped head may be aligned with and inserted into a slot and then rotated to orient the cross-member of the T across the slot.

5. A game apparatus for one of a plurality of players, comprising:

(a) a belt to be worn by the player;

(b) a plurality of belt mounting devices, each belt mounting device comprising means for attaching the belt mounting device to the belt, and means for removably attaching to the belt mounting device different game elements;

(c) first game elements comprising hooks removably attachable to said belt mounting devices;

(d) second game elements comprising spools removably attachable to said belt mounting devices, each spool having wound thereon a length of twine the free end of which has mounted thereon an openable and closable connection loop; and (e) a plurality of rings.

6. The apparatus of claim 5, wherein the rings include rings of two different sizes.

7. The apparatus of claim 5, wherein the means for attaching the belt mounting devices comprises each device having two opposed limbs separated by a substantially belt-thickness space, said limbs being connected along one side to each other forming a U-shaped clip which may be slipped over the belts.

8. The apparatus of claim 5, wherein the means for removably attaching different game elements to the belt mounting device comprises an elongate aperture in each belt mounting device and a T-shaped head on each game device, whereby the T-shaped head may be aligned with and inserted into a slot and then rotated to orient the cross-member of the T across the slot.

* * * * *